US005878659A

United States Patent [19]

Hatter

[11] Patent Number: 5,878,659

[45] Date of Patent: Mar. 9, 1999

[54] TEMPLATE FOR MARKING A GOLF BALL

[76] Inventor: Ronald E. Hatter, 177 Mill Run Rd., Indiana, Pa. 15701

[21] Appl. No.: 67,934

[22] Filed: Apr. 28, 1998

[51] Int. Cl.[6] ..... B41F 17/00

[52] U.S. Cl. ..... 101/35; 101/DIG. 40

[58] Field of Search ..... 101/35, DIG. 40, 101/127, 114, 129

[56] References Cited

U.S. PATENT DOCUMENTS 1,476,203 12/1923 Horne ..... 101/4

3,071,171 1/1963 Guerrero ..... 33/524

*Primary Examiner*—Edgar Burr

*Assistant Examiner*—Minh H. Chau

*Attorney, Agent, or Firm*—George C. Atwell

[57] ABSTRACT

A template for marking golf balls with identifying indicia includes an elongated, rectangular-shaped main body member which is foldable into a cylinder for encompassing the golf ball, a central body portion having a plurality of apertures in the form of letters, numbers, and other symbols arranged thereon, a first end having a flexible tongue formed from a U-shaped slot, and a second end having a transverse slot. When the main body member is rolled into a cylinder for receiving a golf ball for marking, the tongue is inserted through the slot for maintaining the cylindrical form, whereupon the point of a pen can be successively inserted through the appropriate apertures on the central body portion in order to mark the golf ball with an identifying name, symbol, expression, monogram or moniker.

6 Claims, 1 Drawing Sheet

TEMPLATE FOR MARKING A GOLF BALL

BACKGROUND OF THE INVENTION

The present invention pertains to patterns for marking objects, and more particularly pertains to a template for marking golf balls.

Over the last several decades, golf has become one of America's leading sports with sales of golf equipment and paraphernalia rivaling, for example, that of baseball, basketball, football, and hockey. The range of equipment and paraphernalia available to the serious player as well as the recreational aficionado ranges from golf clubs and bags to tees, gloves, spike shoes, and balls. While the recreational player may not want to have his or her equipment and paraphernalia marked for purposes of identification and prestige with a special design or unique monogram, it is common for the serious player to do so.

One piece of equipment which usually has some identifying mark is the golf ball. During a round of golf, players invariably lose golf balls from errant shots into the undergrowth of adjacent fields and woodlands, and also into streams and ponds which may form part of the fairways or be located adjacent to the fairways. The errantly hit golf balls may be found by groundskeepers or other golfers whereupon they are either returned to the clubhouse or pocketed by the finders. If the golf balls are inscribed or marked with the initials of the owner, or with a unique logo or monogram designating the owner, the likelihood of their return is increased.

Moreover, marking or inscribing golf balls with the owner's initials, or with a unique logo or monogram, may be done not only for the utilitarian purpose of identification but for aesthetic and personal reasons. A golfer whose equipment and paraphernalia carry or bear a unique and attractive logo or monogram will stand out in the clubhouse and provide the golfer with a measure of distinctiveness with respect to his or her fellow golfers.

In order to mark or inscribe a golf ball with a unique logo or monogram so that the representation is skillfully and artistically produced, more is required than simply holding the golf ball in one hand and marking or inscribing the golf ball with a pen, stylus, or other writing instrument with the other hand. Inscribing or marking even a single symbol on the golf ball requires patience and skill in that the golf ball must be held motionless in one hand while maintaining the continuous contact of the writing instrument against the hard, dimpled, curved, resistive surface of the golf ball with the other hand. Marking or inscribing the golf ball is made even more difficult if the initials, name, logo or monogram contain a mixture of letters, numbers, symbols, and graphical designs.

A number of devices for marking golf balls have been invented to facilitate the task. The Horne patent (U.S. Pat. No. 1,476,203) discloses a device for marking a golf ball which includes a flexible strip of steel which is wrapped around a golf ball. The strip has a plurality of evenly-spaced openings for receiving the type projecting portion of type blocks. Upper and lower flanges on each type block hold the block to the strip. In order to mark the golf ball, the individual secures the appropriately lettered type blocks to the strip with the type projecting portions facing inwardly toward the golf ball. The strip is then bent into a cylinder and the golf ball is placed within the cylinder so that its surface abuts the lettered surface of the type projecting portions of the type blocks. A pivotable handle which attaches to the opposite ends of the strip is then closed, and this closing action tightens the strip around the ball simultaneously forcing the lettered surface of each type block into the surface of the golf ball. This results in a series of impressions being inscribed into the surface of the golf ball which can take the form of the owner's name, initials, monogram, and telephone number.

While capable of marking a golf ball, the Horne device is cumbersome in that it does not allow the individual to quickly and easily mark a golf ball with various combinations of letters, numbers, and other symbols. In addition, the fact that only nine openings are shown in the strip for receiving type blocks necessarily limits the range of symbols that can be impressed into the outer surface of a golf ball. Therefore, there is a need for a golf ball marking device which is easy to use, quickly positionable about the golf ball, and includes a wide range of symbols for marking golf balls with a variety of words, phrases or logos.

SUMMARY OF THE INVENTION

The present invention comprehends a flexible template for marking a golf ball with a name, logo, monogram, phrase, expression, graphical design, or any of the aforementioned in combination.

The template of the present invention includes an elongated main body member which is planar when the template is in the non-use disposition. The main body member includes a slightly enlarged first attachment end and an oppositely-disposed, and also slightly enlarged second attachment end. The first end includes a U-shaped cut-out or slot which forms a flexible tongue, and the second end includes a transverse slot. The main body member also includes a central body portion or intermediate indicia portion which contains a plurality of specially-formed apertures. The apertures are in the form of the numerals 2 through 9 and the letters of the English alphabet.

When the template is disposed in the marking disposition, the template is folded into a cylinder so that the first end overlays the second end. The flexible tongue is then flexed inward so that it passes through the transverse slot, thus attaching the first and second ends together. A major portion of the tongue extends through the slot and is contiguous against the outer surface of the golf ball, thus filling up the slight space between the template and the golf ball and facilitating a snug reception of the golf ball within the template. The individual can then successively insert the tip of a pen through the respective apertures so that the golf ball can be appropriately marked.

It is an objective of the present invention to provide a template which easily and quickly encompasses a golf ball for marking symbols thereon.

It is another objective of the present invention to provide a template which includes a range of symbols for uniquely marking a golf ball.

Yet another objective of the present invention is to provide a template which is durable and easy to store and transport.

Still another objective of the present invention is to provide a template which can mark other spherical objects such as ping pong balls, tennis balls, baseballs, and softballs.

These and other objects of the invention will become clear from an inspection of the detailed description of the invention, the accompanying figures, and the appended claims.

DETAILED DESCRIPTION OF THE PREFERRED EMBODIMENT

Illustrated in FIGS. 1–4 is a device used for marking, inscribing or impressing indicia in the form of letters, numbers, and symbols on the surface of an object. Specifically, the device of the present invention illustrated in FIGS. 1–4 is a template 10 for marking a golf ball 12 with indicia denoting the owner of the golf ball and other facts pertinent thereto. The indicia may be in the form of a logo, monogram, name, symbol, or expression which uniquely identifies one or more golf balls as belonging to that individual. The indicia can be a unique and distinctive arrangement of letters and symbols, or the indicia appearing on the outer surface of the golf ball 12 may be no more than the initials of the individual's name and his or her phone number. While the template 10 shown in FIGS. 1–4 is intended primarily for use in marking golf balls, the physical dimensions of the template 10 would only need slight enlargement and alteration in order to make template 10 adaptable for marking other spherical objects, such as ping pong balls, tennis balls, baseballs, and softballs.

Figure 1:
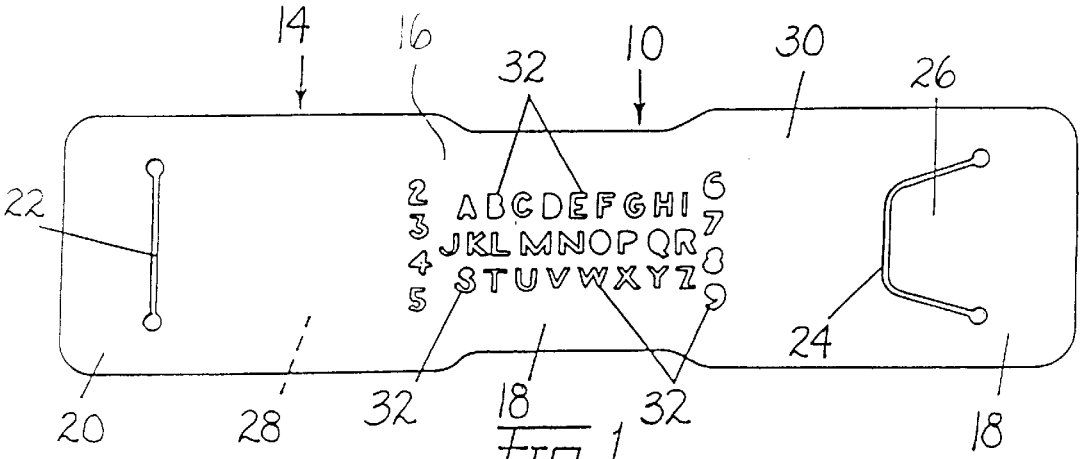
FIG. 1 is a front elevational view of the template of the present invention.
Figure 2:
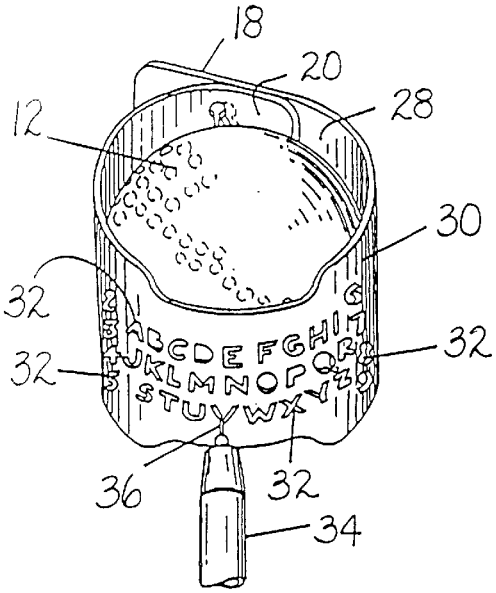
FIG. 2 is a perspective view of the template in the use position wrapped around a golf ball.

As shown in FIGS. 1–4, the template 10 includes an elongated, generally rectangular-shaped main body member 14. When in the non-use disposition, as shown in FIG. 1, the main body member 14 is planar but the template 10 is composed of a material which makes it flexible for wrapping around the golf ball 12, as shown in FIG. 2. The template 10 is preferrably manufactured from a thin, durable plastic, such as butyrate, which is an ester or salt of butyric acid contained in the $C_4H_7O_2$ radical. While the thickness of the template 10 can vary within very slight limits, it has been found that a thickness of 0.030 inches provides the most flexibility, durability, and memory.

As shown in FIG. 1, the main body member 14 can be further distinguished into a central body or intermediate indicia portion 16, a first attachment end 18, and an opposite second attachment end 20. The central body portion 16 is slightly narrower than the ends 18 and 20 so that the template 10 can be more efficiently wrapped around the ball 12. The end 18 includes a tab means for facilitating the removable attachment of the end 20 to the end 18 so that the template 10 can be held in the cylindrical form for marking the ball 12. The end 20 includes a tongue or tab receiving means in the form of an elongated, transverse slot 22 which extends substantially the width of the end 20 when the template 10 is in its non-use, planar disposition.

Figure 3:
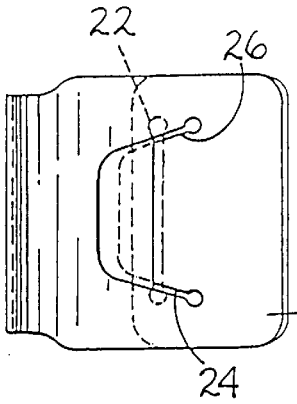
FIG. 3 is a fragmentary elevational view illustrating the way the ends of the template attach to each other.
Figure 4:
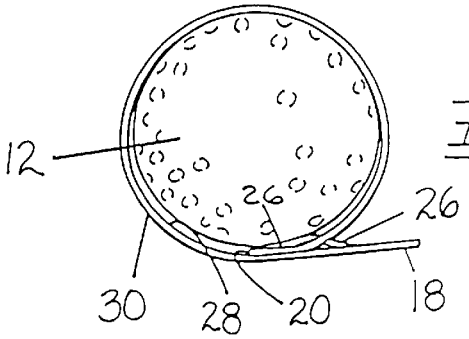
FIG. 4 is a top plan view illustrating the snug fitting and tight registration of the golf ball within the template when the template is formed into a cylinder so that golf ball marking can commence.

As shown in FIGS. 2–4, the end 18 includes an integral and flexible tab means for securing the end 18 to the end 20 whereupon the template 10 is formed into a cylinder for receiving and marking the ball 12. The tab means includes a U-shaped slot or cut-out 24 which forms a tongue 26. The tongue 26 projects toward the central body portion 16. When the template 10 is in the non-use disposition, as shown in FIG. 1, the tongue 26 is coplanar with the main body member 14; however, the tongue 26 is capable of flexing out of or away from the plane defined by the main body member 14 so that the tongue 26 can be secured to the tongue receiving means. The tongue 26 is not capable of flexing away from the plane of the main body member 14 at a right angle thereto but is able to readily and easily flex far enough from the plane formed by the main body member 14 to permit full and easy attachment to the end 20. In order to attach the end 18 to the end 20, the main body member 14 must be folded or wrapped into a cylinder so that the ends 18 and 20 are brought into close proximity. The individual then simply flexes the tongue 26 inward toward the imaginary axis (not shown) formed by the cylinder and passes the tongue 26 through the slot 22, thereby securing the ends 18 and 20 together for forming and maintaining the cylindrical shape of the template 10. The surface of the template 10 that faces the ball 12 may be referred to as the golf ball-facing surface 28, while the opposite surface may be referred to as the golf ball-marking surface 30.

As shown in FIGS. 1 and 2, the central body portion 16 also includes a plurality of apertures 32 arranged within the central body portion 16 to permit marking of the ball 12. The apertures 32 are in the form of letters, numbers, and symbols, and a selected number of apertures can represent the letters of the English alphabet or the letters and symbols of any other alphabet. In the template 10 of the present invention the apertures 32 are in the shape of the letters of the English alphabet and the numerals 2 through 9. As will be explained more fully hereinafter, the apertures 32 representing the letters and numbers are specifically arranged within the central body portion 16 in order to minimize or completely avoid the necessity of fully rotating the ball 12 in order to mark the ball 12. For marking the ball 12, a permanent marking pen 34, such as the marking pen denoted by the tradename PILOT, is preferable because of the long-lasting adherence of the ink to the outer surface of the ball 12.

With reference to FIGS. 1–4, one method of marking the ball 12 will now be described. The template 10 of the present invention is sized and shaped to encompass the standard-sized ball 12; while the template 10 can accommodate over-sized golf balls, these types of golf balls are not as popular so there is less need to design a template to accommodate them. With the template 10 disposed in its non-use, planar disposition, the individual takes the ends 18 and 20 in his hands and bends them toward each other so that the template 10 is formed into a cylinder. In order to most effectively secure the end 18 to the end 20, the individual bends the end 20 underneath the end 18 and then flexes the tongue 26 inward so that the tongue 26 is no longer coplanar with the main body member 14. Insertion of the tongue 26 through the slot 22 can now occur as shown in FIGS. 3 and 4.

Thus, as shown most clearly in FIG. 4, a major portion of the tongue 26 is inserted through the slot 22 and abuts the outer surface of the ball 12. As a result, the space that exists between the cylindrically-formed template 10 and the ball 12 is filled by a major portion of the flexed tongue 26. This eliminates much of the play that could occur between the outer surface of the ball 12 and the surface 28 of the template 10 and, thus, the projection of a major portion of the tongue 26 on the inside of the cylindrically-formed template 10 assists in keeping the ball 12 firmly in place within the template 10. With the ball 12 placed within and encompassed by the cylindrically-formed template 10, as shown in FIG. 2, marking of the ball 12 can now occur.

The individual would take the appropriate type of pen 34 and sequentially insert the tip 36 through the appropriate apertures 32 to mark on the ball 12 the desired initials, telephone number, monogram, phrase, expression, etc. In order to physically mark the ball 12, either the ball 12 can be rotated within the cylindrically-formed template 10 or the template 10 can be rotated around the ball 12 with the ball 12 being held stationary during rotation of the template 10 thereabout. It has been found that the easiest and most efficient way to mark the ball 12 is to rotate the ball 12 within the template 10. After the individual has marked the ball 12 with the desired indicia, the ball 12 can be removed from its temporary seating within the cylindrically-formed template 10. The individual then draws the end 18 away from the end 20, pulling the tongue 26 backward through the slot 22 so that the tongue 26 completely clears the slot 22, whereupon the template 10 can be returned to its normally planar disposition for future use.

The foregoing is considered as illustrative only of the principles of the invention. Further, since numerous modifications and changes will readily occur to those skilled in the art, it is not desired to limit the invention to the exact construction and operation shown and described, and, accordingly, suitable modifications and equivalents may be resorted to, falling within the scope of the invention.

I claim:

1. A template for marking a golf ball, comprising:

an elongated, flexible, planar member having a first attachment end, an opposite second attachment end, and an intermediate indicia portion;

the intermediate indicia including a plurality of apertures in the form of numbers and letters;

the first attachment end having an integral and flexible tab means for securing the first attachment end to the second attachment end;

the second attachment end having a tab receiving means for allowing removable securement of the tab means thereto; and the flexible member being formable as a cylinder so that a golf ball can be disposed therein for marking when the tab means is secured to the tab receiving means.

2. The template of claim 1 wherein the tab means includes an integral and flexible tongue cut out from the first attachment end and coplanar with the planar member when the planar member is in the non-use disposition, the tongue capable of flexing away from the plane of the planar member for securement to the tab receiving means.

3. The template of claim 2 wherein the tab receiving means includes an elongated slot having a width for allowing the flexible tongue to pass therethrough so that the first attachment end can be flexed and inserted therethrough for securement to the second attachment end.

4. The template of claim 3 wherein the securement of the first attachment end to the second attachment end causes the planar member to form a cylinder rotatable about the golf ball for selective marking of the golf ball.

5. The template of claim 4 wherein the securement of the first attachment end to the second attachment end causes the planar member to form a cylinder which encompasses the golf ball allowing the golf ball to be rotatable therein for selective marking of the golf ball.

6. A template for marking a spherical object, comprising:

an elongated, flexible, planar member having a first attachment end, an opposite second attachment end, and an intermediate indicia portion;

the intermediate indicia including a plurality of apertures in the form of numbers and letters;

the first attachment end having an integral and flexible tab means for securing the first attachment end to the second attachment end;

the second attachment end having a tab receiving means for allowing removable securement of the tab means thereto; and the flexible member being formable as a cylinder so that a spherical object can be disposed therein for marking when the tab means is secured to the tab receiving means.

* * * * *